US005770055A

United States Patent [19]

Wallander et al.

[11] Patent Number: 5,770,055

[45] Date of Patent: Jun. 23, 1998

[54] STRAINER FOR REMOVING PARTICLES FROM EFFLUENT

[75] Inventors: Carl-Otto Wallander, Vaglängdsgatan; Lars Hedman, Taillepied, both of Sweden

[73] Assignee: Erich Hochstrasser, Rothenburg, Switzerland

[21] Appl. No.: 500,957

[22] PCT Filed: Jan. 28, 1994

[86] PCT No.: PCT/SE94/00062

§ 371 Date: Sep. 22, 1995

§ 102(e) Date: Sep. 22, 1995

[87] PCT Pub. No.: WO94/24373

PCT Pub. Date: Oct. 27, 1994

[30] Foreign Application Priority Data

Feb. 8, 1993 [SE] Sweden ..... 9300396

[51] Int. Cl.[6] ..... E02B 5/08; B01D 29/70; B01D 33/52

[52] U.S. Cl. ..... 210/154; 210/155; 210/159; 210/162; 210/357

[58] Field of Search ..... 210/158, 159, 210/162, 154, 357, 155

[56] References Cited

U.S. PATENT DOCUMENTS

| | | | |
|---|---|---|---|
| 1,698,387 | 1/1929 | Brome . | |
| 1,751,421 | 3/1930 | Reid . | |
| 1,751,422 | 3/1930 | Reid . | |
| 1,773,576 | 8/1930 | Downes . | |
| 4,853,116 | 8/1989 | Wallander . | |
| 5,013,430 | 5/1991 | Mileson | 210/159 |
| 5,032,262 | 7/1991 | Wallander . | |
| 5,098,561 | 3/1992 | Grabbe . | |

FOREIGN PATENT DOCUMENTS

| | | |
|---|---|---|
| 0 221991B1 | 5/1987 | European Pat. Off. . |
| WO92/21824 | 12/1992 | WIPO . |

*Primary Examiner*—Thomas M. Lithgow
*Attorney, Agent, or Firm*—Klarquist Sparkman Campbell Leigh & Whinston, LLP

[57] ABSTRACT

A strainer for removing particles from a horizontal flow of effluent comprises a plurality of parallel fixed bars adapted to extend angularly downwardly into the flow of effluent and a set of parallel displaceable bars interdigited with the fixed bars. The displaceable bars are interconnected and connected to a drive mechanism to cause the displaceable bars to move in a circuitous path such that the displaceable bars move upwardly relative to the fixed bars to remove material engaged thereon and are thence thereafter lowered, whereby the material is lifted upwardly along the fixed bars. The displaceable bars are supported at their lower ends to the drive mechanism by a flexible connection apparatus so that the path of movement of the displaceable bars is unconstrained to minimize stress on the strainer should debris become lodged beneath the lower end of the displaceable bars.

12 Claims, 2 Drawing Sheets

STRAINER FOR REMOVING PARTICLES FROM EFFLUENT

TECHNICAL FIELD

The present invention refers to a strainer for removing particles from effluent, comprising a screen with a plurality of fixed parallel aligned bars and displaceable bars, arranged in a plane inclined downwards into a flow of water, with the edges of said bars turned towards the flow direction of the water being stepped, and the displaceable bars being interconnected in parallel to at least one package, which is operable by means of a drive mechanism, located at the upper end of the strainer, above the flow of water, to bring about a closed circuitous path in the plane of the bars, said path including a vertical component of movement surpassing the step height of the bars.

BACKGROUND OF THE INVENTION

Strainers according to above are used for instance by sewage disposal plants for separation of particles from effluent and are among other known from SE 448106.

Due to the existence of hair and other fibres as well as abrasive particles in the liquid, it is expedient to locate the drive mechanism and those moving parts that are connected to it above the surface of the effluent. This has entailed certain drawbacks, for example due to the need for a relatively high and bulky stand for the installation of the strainer. During the installation, it is necessary to level the stand and make exact alignments for the support of the displaceable part of the strainer, so that the shafts become parallel. By the positioning of the bearings for the displaceable part of the strainer rather high above the bottom end of the strainer, a leverage will be created as a result of the pressure of the water against the lower part of the strainer, which causes strains in the construction which must be compensated for by upgrading of bearings and the material thickness.

Strainers also exist which have a more simple design, by which the drive means for rendering the bottom part of the displaceable strainer a closed circuitous path has been omitted in order to lower the costs for manufacture and installation. Therefore, this part of the strainer will only move back and forth and will not participate efficiently in upwards feeding motion.

THE TECHNICAL PROBLEM

One purpose of the present invention is to provide a strainer which can be manufactured for less costs and be installed more easily than before, without having the functional drawbacks.

THE SOLUTION

This is achieved in accordance with the invention in that the drive mechanism is connected via at least one pull means to a respective link mechanism, which is located at the bottom end of the strainer in the flow of the water to support the bottom end of the displaceable bar package.

SPECIFICATION OF THE DRAWINGS

The invention is described hereinafter with reference to an embodiment which is shown in the enclosed drawings, wherein FIG. 1 discloses a strainer according to the invention in a side view, FIG. 2 shows the strainer in FIG. 1 in a front view, FIG. 3 is a view from below of the strainer mainly showing its drive mechanism, FIG. 4 is a side view disclosing in an enlarged scale, the bottom end of the strainer, and FIG. 5 shows the encapsulation of the link arms.

DESCRIPTION OF EMBODIMENT

Figure 1:
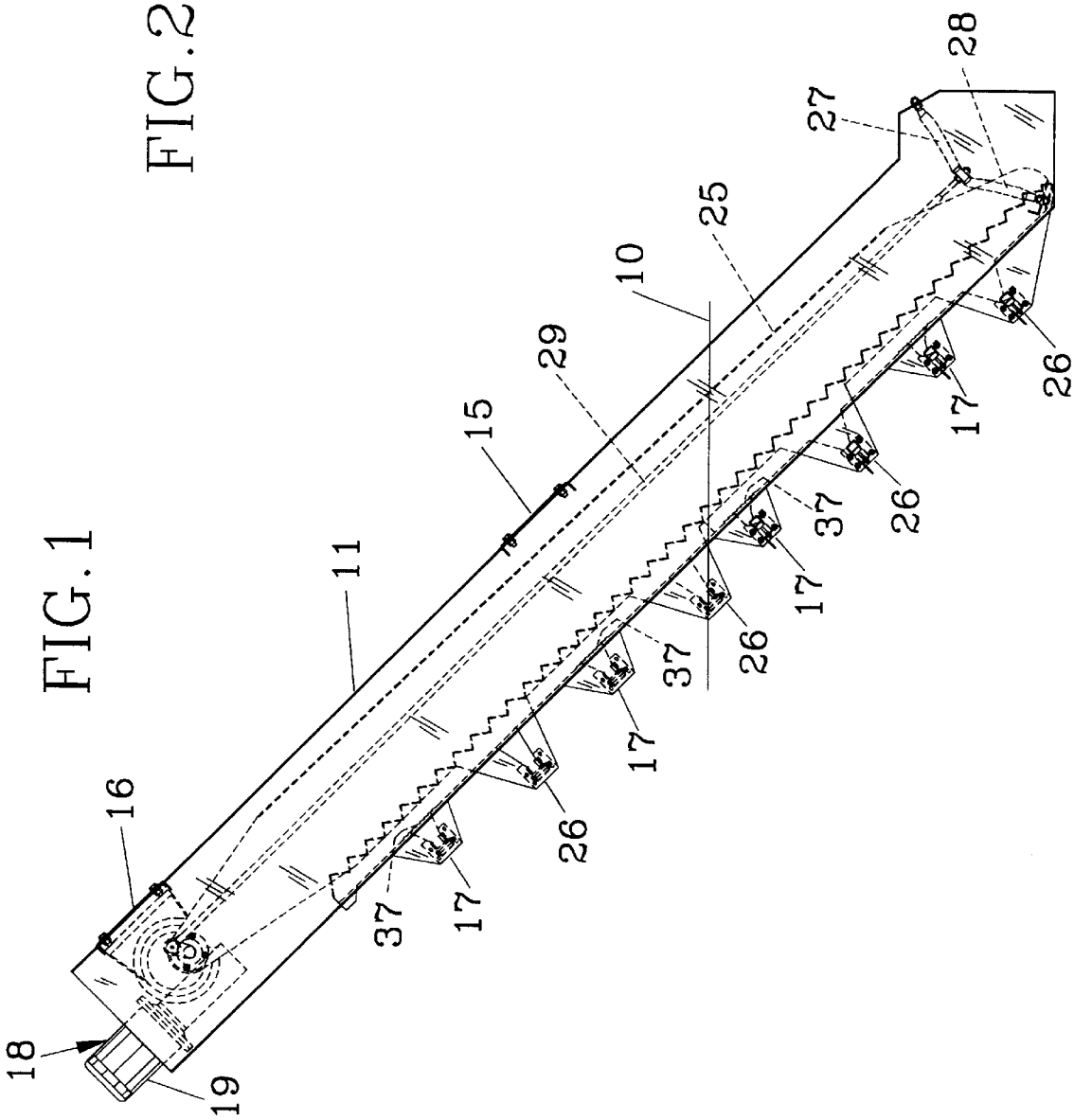

The strainer according to the invention is in accordance with prior art installed as an inclined plane in a not shown channel or flume, in such a manner that it reaches down with its bottom end into a stream of effluent which is to be treated. The bottom end of the strainer is supported on the channel bottom and the level of the fluid normally reaches up approximately to level line 10 in FIG. 1.

Figure 2:
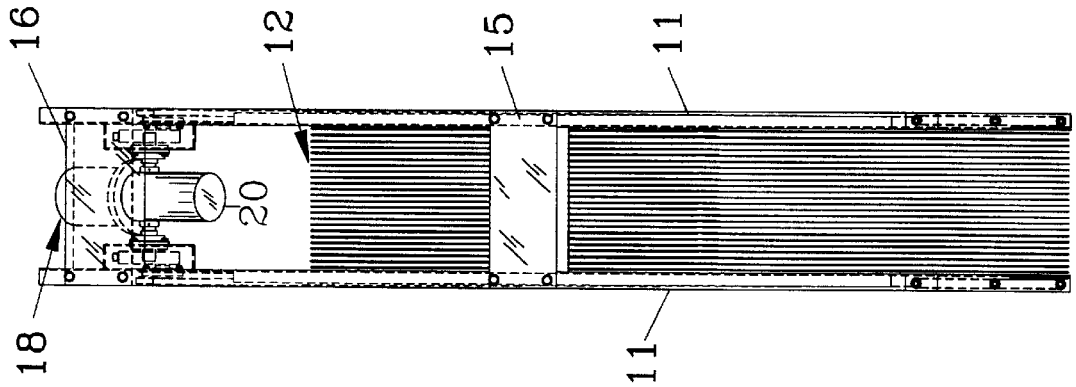
Figure 4:
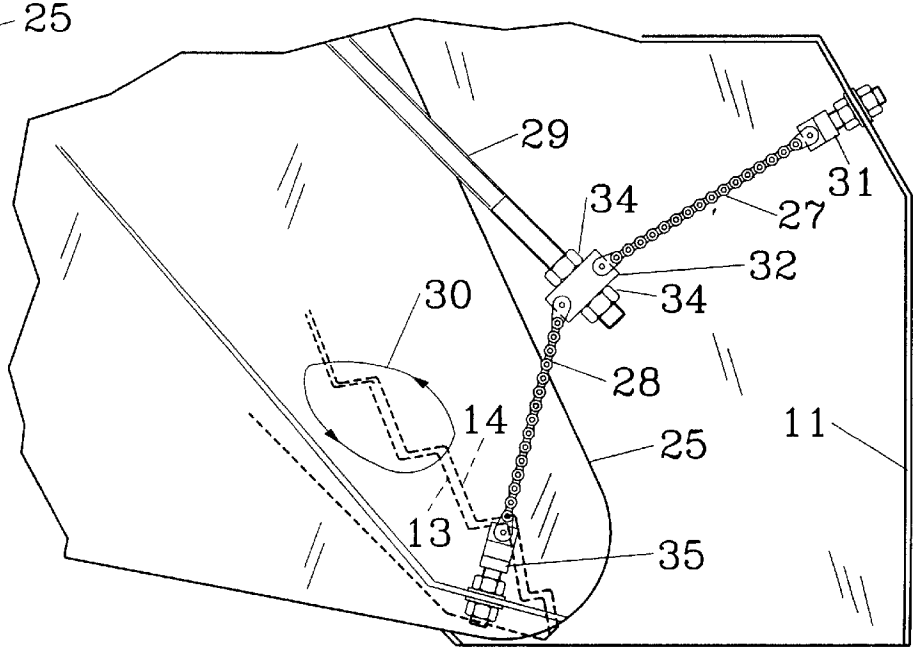

The device includes a screen 12 located in the accommodation between two side beams 11 (see FIG. 2), which screen according to prior art includes alternately fixed and displaceable bars 13 and 14 respectively (see FIG. 4) to form an oblique plane downwards into the flowing water, with the edges of the bars 13, 14 which are turned towards the flow direction of the water being stepped. In this manner, the set of bars 13, 14 form a fixed grid package and a displaceable grid package, of which the latter performs a closed circuitous path 30 with a vertical component of movement surpassing the step height of the bars. The ledges of the steps are substantially horizontally or lean somewhat downward as seen from frontal edge of the ledges, when the device is installed in operational position in the channel.

During the movement of the displaceable bar package, objects and particles are picked up and moved in successive steps upwards, until they can pass over from the topmost step to a subsequent, not shown conveyor, e.g. an endless belt conveyor.

The side beams 11 are interconnected by means of two cross beams 15, 16 located above the water surface 10. Also, a number of crosspieces 17 interconnect both side beams downstream the bars. The crosspieces 17 support the bars 13 of the fixed bar package.

Figure 3:
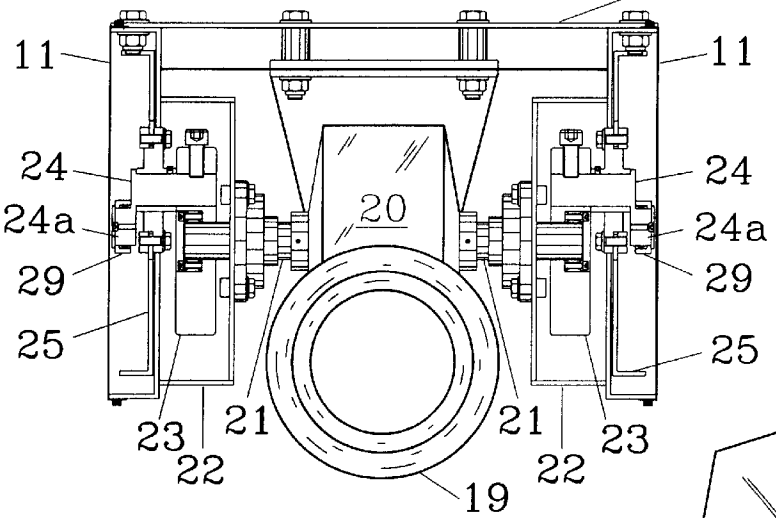

The side beams 11 and the upper cross beam 16 support a drive mechanism 18, which is shown in more detail in FIG. 3. The drive mechanism 18 includes an electric motor 19, a reduction gear box 20 and an output shaft 21. The shaft 21 is connected with flywheels 23 which are rotatably journalled in housings 22 at each side beam 11. An eccentric pivot 24 is mounted on each flywheel to form a pivot point for a support beam 25 which is displaceable at the outside of each side beam 11, which extend downwards to the bottom end of the strainer and support the displaceable bars 14 via crosspieces 26.

Figure 5:
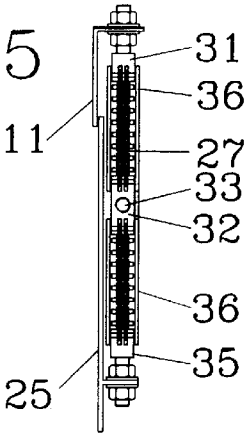

Consequently, the upper part of the support beam 25 moves eccentrically about the shaft 21 and transmit this motion to the upper part of the displaceable bar package. The eccentric movement would normally decline successively in direction downwards, and would be transferred into a back and forth motion at the bottom of the displaceable bar package. However, this bottom part of the displaceable bar package is suspended an between upper flexible and lower flexible link, 27 and 28 respectively, and the connection point between the upper and the lower link is connected to the pivot 24 via a connecting rod 29, and a crankshaft 24a which forms a pivot, point which is somewhat angularly displaced in relation to the pivot 24 thus, the motion of the connecting rod will be some degrees out of phase with the motion of the support beam 25. As a result of the symmetry of the links 27, 28 and the motion of the connecting rod 29, the bottom part of the displaceable bar package will follow the curve 30 in FIG. 4. The upper link 27 comprises a roller chain running from an attachment 31 at each side beam 11 to a holder 32 that is displaceably attached via a chore 33 (see FIG. 5) to the connecting rod 29 and can be by means of screw nuts 34. Also the bottom link 28 is constituted by a roller chain running from the holder 32 to an attachment 35 at each respective support beam 25. All roller chains are encapsulated by means of pieces of flexible pipe 36, which preferably are secured by pipe clamps and contain bearing grease for the chain rollers.

By hinging the bottom part of the displaceable bar package flexibly via the chain links 27, 28, strains upon the drive mechanism 18 are reduced, e.g. if a small stone should follow the water stream along the channel bottom towards the bottom part of the strainer. This could otherwise lead to operational interrupts at a strainer entirely operating with constrained motion.

To avoid blocking of the strainer, the displaceable bars 14 are preferably provided with saw teeth 37 at their downstream edge at those parts which are located in front of the crosspieces 17 for the fixed bars 13. Each time the displaceable bars perform a power stroke, the saw teeth 37 will tear away hair and other matter that has adhered onto the crosspieces 17.

Through its simple self-supporting construction with stout side cross beams, the strainer will be simple to manufacture and install.

The strainer according to the invention is not limited to links of the chain roller type, but these can be replaced by common rigid arms. Besides, the links can cooperate in other ways than shown, for example, a first link can run between the attachments 31 and 35, and another link can connect the attachment 35 with the bottom end of the connecting rod 29. Further, a link mechanism at each side of the strainer is not necessary, but can be replaced by a centrally located mechanism between two in V-form against each other inclined screens. The drive mechanism can be designed differently.

We claim:

1. A strainer for removing particles from horizontal flow of effluent, comprising:

a screen having a plurality of parallel fixed bars and a plurality of parallel displaceable bars, the fixed and displaceable bars being adapted to be inclined downwards into the flow of effluent and having edges for facing the flow of effluent that have step portions, the displaccable bars being interconnected to form a displaceable bar package with a lower end and an upper and;

a drive mechanism operably connected to the upper end of the displaceable bar package for driving the upper end of the displaceable bar package in a constrained first circuitous path, and said drive mechanism is operably connected to the lower end of the displaceable bar package by a flexible link mechanism means for driving said lower end in a second circuitous path which is unconstrained, said flexible link mechanism means allowing said second unconstrained circuitous path of said lower end of the displacable bar package to flexibly vary to minimize stress on the strainer should debris become lodged beneath the lower end of the displaceable bar package.

2. A strainer according to claim 1 wherein said second circuitous path has forward, reverse, upward and downward components, wherein said drive mechanism comprises a pull member connected to said link mechanism means and operable to pull the link mechanism means to provide motion to said displaceable bar package along the upward component of the second circuitous path, and wherein the motion along the downward component of the second circuitous path is provided by gravity.

3. A strainer according to claim 2, wherein the motion along the downward component of the circuitous path is provided by gravity and a spring mechanism.

4. A strainer according to claim 2 wherein the pull member is a connecting rod with an upper rod end and a lower rod end.

5. A strainer according to claim 4, wherein the link mechanism means includes a first link extending between a fixed point on the strainer and the lower rod end, and a second link extending between the lower rod end and an attachment at the lower end of the displaceable bar package.

6. A strainer according to claim 4, wherein the drive mechanism further includes means operably connected to said upper rod end to move the connecting rod in reciprocating forward and reverse motion.

7. A strainer according to claim 6, wherein the forward and reverse motion of the connecting rod is out of phase with movement of the displaceable bar package along the forward and reverse components, respectively, of said first circuitous path, in such a manner that the connecting rod forward motion occurs slightly ahead of the motion of the bar package along the forward component of said first circuitous path.

8. A strainer according to claim 5, wherein the link mechanism means includes chains that flexibly support the lower end of the displaceable bar package.

9. A strainer according to claim 4, wherein the connecting rod and the link mechanism means are provided in each of a pair of partitions extending along longitudinal sides of the strainer.

10. A strainer according to claim 9, further comprising a support beam provided in each of the partitions that is connected to the displaceable bar package.

11. A strainer according to claim 9, wherein each support beam has an upper beam end adjacent the upper end of the displaceable bar package and a lower beam end adjacent the lower end of the displaceable bar package;

the drive mechanism has a rotatable shaft extending perpendicularly of the fixed and displaceable bars, and each support beam is rotatably and eccentrically connected to the shaft such that the upper portion of each support beam is movable in a circular path by the rotation of the rotatable shaft.

12. A strainer for removing particles from a flow of effluent, comprising:

a screen having a plurality of parallel fixed bars and a plurality of parallel displaceable bars, the fixed and displaceable bars inclined downwards into the flow of effluent and having edges facing the flow of effluent that have stepped portions, the displaceable bars being interconnected to form a displaceable bar package with a lower end and an upper end;

a drive mechanism having a rotatable shaft extending perpendicularly of the fixed and displaceable bars;

the upper end of the displaceable bar package being eccentrically and rotatably connected to the shaft for movement along a first circuitous path in a plane perpendicular of the shaft; and a connecting rod being eccentrically and rotatably connected to the shaft, and extending and connected to a flexible link mechanism means the flexible link mechanism means connected to the lower end of the displaceable bar package, the lower end of the displaceable bar package being driven by rotation of the shaft in a second unconstrained circuitous path, said flexible link mechanism means allowing said second unconstrained circuitous path of said lower end of said displaceable bar package to flexibly vary to minimize stress on the strainer should debris become lodged beneath the lower end of the displaceable bar package.

* * * * *

UNITED STATES PATENT AND TRADEMARK OFFICE

CERTIFICATE OF CORRECTION

PATENT NO. : 5,770,055

DATED : June 23, 1998

INVENTOR(S) : Carl-Otto Wallander and Lars Hedman

It is certified that error appears in the above-indentified patent and that said Letters Patent is hereby corrected as shown below:

On the title page, item [75] Inventors,

Change the residence of inventor Carl-Ott Wallander from "Vaglängdsgatan" to --Västra Frölunda, Sweden--.

Change the residence of inventor Lars Hedman from "Taillepied, Sweden" to --Lutry, Switzerland--.

Column 2, line 28, delete "are substantially" and insert thereof --are arranged substantially--.

Column 2, line 54, delete "transmit" and insert thereof --transmits--.

Column 2, line 64, change "pivot, point" to --pivot point--.

Column 2, line 65, delete "thus," and insert thereof --, thus,--.

Column 3, line 5, delete "chore" and insert thereof --bore--.

Column 3, line 6, delete "be by" and insert thereof --be locked by--.

Column 3, line 51, delete "upper and" and insert thereof --upper end--.

Signed and Sealed this

Ninth Day of November, 1999

*Attest:*

Q. TODD DICKINSON

*Attesting Officer*

*Acting Commissioner of Patents and Trademarks*